United States Patent [19]

Lundblad

[11] Patent Number: 4,500,013

[45] Date of Patent: Feb. 19, 1985

[54] APPARATUS IN BANKS, POST OFFICES AND SIMILAR ESTABLISHMENTS FOR DISPENSING VALUABLE PAPERS

[76] Inventor: Leif Lundblad, Häradsvägen 102, S-141 41 Huddinge, Sweden

[21] Appl. No.: 473,031

[22] Filed: Mar. 7, 1983

[51] Int. Cl.[3] ..... E05G 1/00

[52] U.S. Cl. ..... 221/285; 109/50

[58] Field of Search ..... 109/50, 51, 52; 221/285, 154; 312/349, 350, 249, 252; 194/1 A

[56] References Cited

U.S. PATENT DOCUMENTS 1,607,361 11/1926 Poland et al. ..... 109/51 X 4,258,632 3/1981 LaPointe ..... 109/52 X

FOREIGN PATENT DOCUMENTS 368507 3/1932 United Kingdom ..... 109/51

*Primary Examiner*—Stanley H. Tollberg

*Attorney, Agent, or Firm*—Kinzer, Plyer, Dorn & McEachran

[57] ABSTRACT

An apparatus for dispensing bank notes, comprising a cabinet housing, a bank note store, electronic components, and a base assembly which forms a base for the cabinet and which can be attached to a wall or a floor of a room in which the apparatus is to be used. The base assembly comprises a support plate arranged to permit limited rotation of the cabinet relative to the support assembly. Arranged on the undersurface of the cabinet is a number of balls on which the cabinet rolls as it is rotated and four rest pads against which four runners mounted in respective corners of the support plate rest when the cabinet is located in its customer serving position or its refilling and servicing position. Arranged in the cabinet is a locking arrangement which can be caused to cooperate with locking grooves arranged in the support base when the cabinet is located in its customer serving position or its refilling position. Cables extending from the cabinet are coiled in a recess in the base assembly and are drawn from the base assembly close to the wall in which the base assembly is fixedly mounted, in the case of a wall attachment. The rest pads are wedge shaped so that when the cabinet is rotated, it is initially lowered and then raised.

18 Claims, 9 Drawing Figures

APPARATUS IN BANKS, POST OFFICES AND SIMILAR ESTABLISHMENTS FOR DISPENSING VALUABLE PAPERS

TECHNICAL FIELD

The present invention relates to apparatus in banks, post offices and similar establishments for dispensing such valuable items as banknotes, cheques etc., from a store of said items to a receipt opening available to the customer. The apparatus includes a cabinet for housing the various apparatus components, such as the aforementioned store, means for conveying valuable items from the store to a receipt opening, one or more keyboards and said receipt opening. The cabinet has a lockable door, through which access is afforded to the store and to the mechanical and the electronic units of the apparatus, for re-filling and servicing purposes respectively.

BACKGROUND ART

Apparatus of this kind are known and, for security reasons, are normally in the form of permanent structures built more or less into the structure of the building in which they are intended to give service to the general public. When wishing to place the cabinet adjacent a wall of the room in which the apparatus is to be installed, or in a corner of the room, the number of possible locations is limited because sufficient room must be allowed for opening and closing the door. Permanently or fixedly installed apparatus may afford but limited access for re-filling the store or for servicing the apparatus components, and may restrict the use to which the room can be put. In addition, the costs of permanently installing such apparatus are relatively high and the presence of such an apparatus in a room may create a problem when wishing to re-allocate rooms between different departments of the establishment in question.

Consequently, a prime object of the invention is to provide an apparatus of the kind described in the introduction, which reduces the drawbacks mentioned above.

DESCRIPTION OF THE INVENTION

An apparatus according to the invention includes a base assembly which is adapted to the cabinet and which mainly comprises a support plate, a spacer arrangement and a base plate arranged for attachment to a fixed wall or to the floor of a room. The support plate and the bottom of the cabinet are designed to permit limited relative rotation between the cabinet and the support plate, thereby to enable the cabinet to be rotated from a normal service-position, in which it can be used by clients, to a position in which the door can be opened for filling the store and/or servicing the apparatus components. Consequently, it is not necessary for the door to be openable when the cabinet is located in its normal, service position, and hence no account need be taken of space required for opening and closing the door when positioning the apparatus in relation to the walls of the room. The only limitation is that created by the largest radius of rotation of the cabinet and the cabinet can therefore be placed closer to a wall than could a permanently installed, non-rotatable apparatus. The cabinet is pivotally mounted on a center post fixed to the base plate and is locked axially to the post by means of a nut or some other suitable locking device.

The base plate has a horizontal part and, optionally, a vertical part which is arranged for fixed attachment to a wall. Thus, the apparatus can be readily installed since all that is required is for the apparatus to be mounted on the floor or in a wall, and the necessary cables installed. Such an arrangement affords additional security against robbery and unauthorized access to the cabinet, the aforementioned access to the store and apparatus components for re-filling and servicing purposes, the possibility of utilizing existing rooms more efficiently and greater flexibility in re-allocating rooms, coupled with extremely low installation costs.

The support plate and the base plate are so designed as to enable them to be assembled together in five different ways, such that the cabinet can be placed in five mutually different positions in relation to the base plate and the vertical part thereof, said vertical part being intended for attachment to a wall of the room in which the apparatus is to be installed. Four of the aforementioned assembly positions enable the cabinet to be placed in a corner of a room in three different positions of use. Thus, the cabinet, which is of rectangular shape, can be placed with one or the other of its short sides along a wall, or at an angle of 45° to said corner and with the vertical part of the base plate against a corner wall. The fifth assembly position enables the cabinet to be placed with one long side thereof against a wall.

The support plate, the spacer arrangement, the base plate and a cable protector together form a space, in which cables extending from a wall into the cabinet lie protected. These cables lie in helical coils in a circular space formed by the base plate, the spacer arrangement and the support plate thereby enabling the cables to be withdrawn and returned during rotation of the cabinet. The cables are fixedly mounted in the cabinet, and consequently it is the cabinet which draws and returns the cables during rotation of the cabinet.

Arranged in the corner areas of the support plate are casters or like runners, so that the cabinet is seated firmly on the foundations when in its normal, service position or its re-filling position. Arranged on the bottom of the cabinet, outwardly thereof, are a number of casters or like runners, which are arranged to roll against the support plate in one or more circular paths. The underside of the cabinet is provided in the region of its corners with wedge-shaped resting pads which serve as abutments for the casters of the support plate when the cabinet is located in the customer serving position or in the re-filling position. The rest pads are so arranged that during the first stage of rotation of the cabinet, the cabinet is lowered until the casters or like rollers mounted on the cabinet come into abutment with the surface of the support plate and is lifted up on the casters or like rollers mounted on the support plate during the final stage of rotation of said cabinet.

The cabinet is provided with a latching and locking means arranged to fix and lock the cabinet relative to the support plate. The arrangement is such that the cabinet can be locked in its customer serving position and its re-filling position. The latching and locking means is such that the cabinet can be locked when located only approximately in the aforementioned service position or re-filling position, thereby rendering it unnecessary to rotate the cabinet precisely to these positions for locking purposes. The cabinet is locked in its selected position by means of locking devices located on the cabinet and arranged to engage with one or more corresponding locking means in the support plate. If the mutually co-acting locking means are not immediately effective in the selected locking position of the cabinet, they will become effective as soon as the cabinet is turned slightly in one direction or the other.

BRIEF DESCRIPTION OF THE DRAWINGS

The invention will now be described in more detail with reference to the accompanying drawings, in which.

PREFERRED EMBODIMENT OF THE INVENTION

Figure 1:
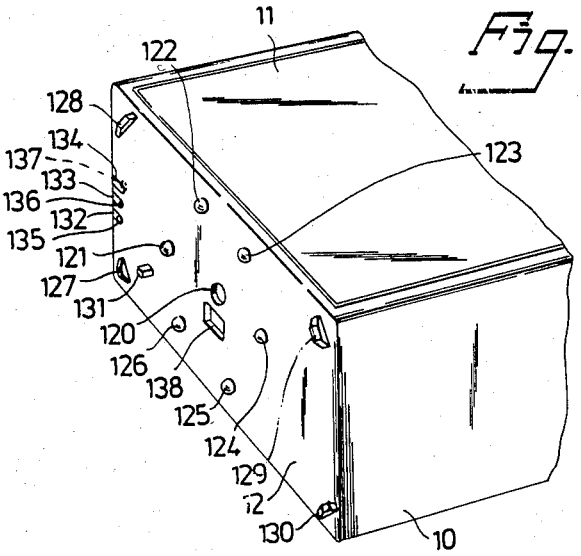
FIG. 1 is a bottom view, in perspective, of part of the cabinet in which an apparatus for dispensing valuable items is housed.

In FIG. 1 the reference 10 identifies the lower part of a cabinet in which there is housed an apparatus for dispensing such valuable items as banknotes, cheques, tickets etc. In the illustrated embodiment, the cabinet has an oblong cross-sectional shape, and is provided on one side with a door 11. Arranged in the four corners of the rectangular underside of the cabinet are restpads 127–130, which are intended as abutment surfaces for casters, rollers or like runners. Arranged in the center of said underside is an aperture 120 for accomodating a center post, while arranged to one side of the aperture 120 is a further aperture 138 through which cables through the interior of the cabinet extend. Arranged around the aperture 120 at mutually different distances therefrom are six support rollers 121–126 on which the cabinet 10 together with its contents can readily roll when the cabinet is rotated relative to a support plate illustrated in FIG. 3 and hereinafter described. Also arranged on the underside of the cabinet is a fixed stop 131 for limiting the extent to which the cabinet can be rotated, and guide holes 132–134 for receiving locking means 135–137, see FIG. 8, for locking the cabinet in selected positions.

To enable the cabinet 10 to move smoothly when rotated between different selected positions, the rest pads 128 and 130 are placed equidistant from the center, and the rest pads 127 and 129 are positioned at mutually equal distances from the center, these distances, however, being somewhat shorter than the first mentioned distances.

Figure 2:
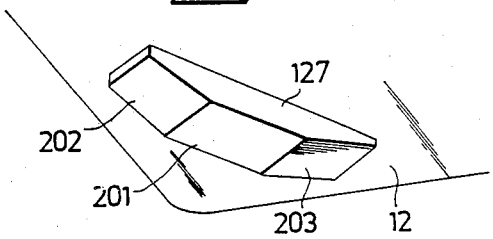
FIG. 2 illustrates a rest pad mounted on the under surface of the cabinet.

A rest pad 127 mounted in a corner of the underside 12 of the cabinet 10 is illustrated in larger scale in FIG. 2. As will be seen from the figure, the rest pad comprises a central, horizontal abutment surface 201 defined at each end by two wedge-shaped surfaces 202, 203 arranged to lift and lower the cabinet during its rotation.

Figure 3:
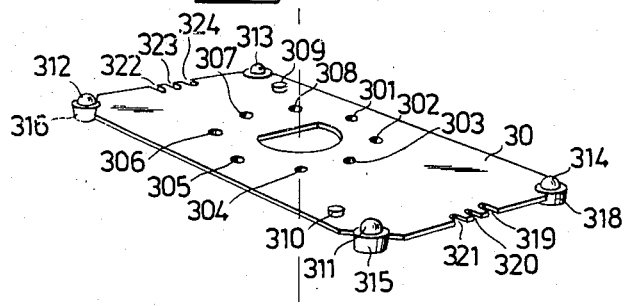
FIG. 3 illustrates a support plate adapted to the cabinet.
Figure 6:
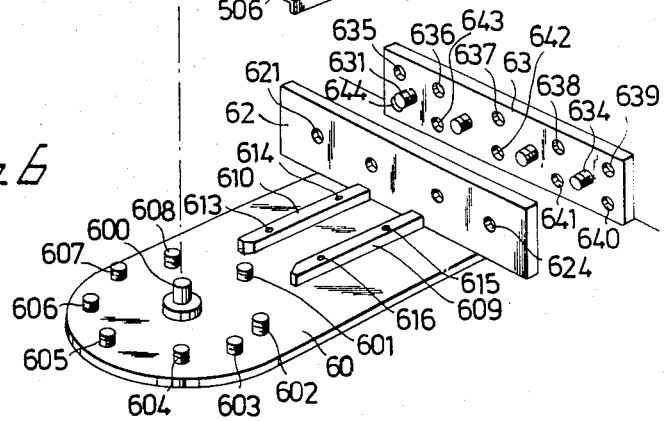
FIG. 6 illustrates a base plate for mounting the cabinet, a support plate, the spacer arrangement and the cable protector to a fixed wall.

Similar to the underside 12 of the cabinet 10, the support plate 30 illustrated in FIG. 3 is also of oblong configuration, and has a relatively large central opening 300, around which are arranged eight apertures 301–308 which are intended to receive fixing bolts, see FIG. 6. The four corners of the support plate have the form of feet 315–318, each incorporating a respective one of four ball supports 311–314, arranged to lie against the rest pads 127–130 on the underside 12 of the cabinet 10 when said cabinet is located in its customer serving position or its re-filling position. The diagonal distance between the balls 311 and 313 is somewhat shorter than the diagonal distance between the balls 312 and 314. Arranged in the vicinity of two of the corners is a respective stop 309, 310, arranged to co-act, one at a time, with the fixed stop 131 on the underside 12 of the cabinet 10. Arranged centrally of each of the two short sides of the plate are respective locking grooves 319–321 and 322–324, which are intended to co-act with locking means 135–137, see FIG. 8, hereinafter described.

Figure 4:
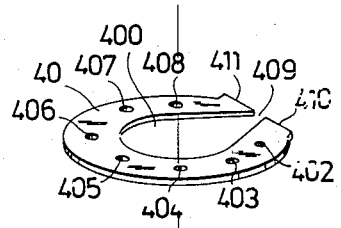
FIG. 4 illustrates a spacer arrangement mounted beneath said support plate.

Referring to FIG. 4, the spacer member 40 has a substantially circular configuration and is provided with a relatively large central opening 400, a peripheral recess 409 and seven relatively small holes 402–408, which correspond to seven of the holes 301–308 in plate 30. The end surfaces 410, 411 of the spacer element adjacent the peripheral opening 409 are substantially planar.

Figure 5:
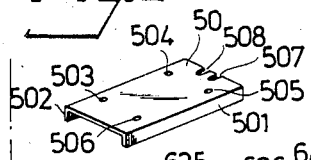
FIG. 5 illustrates a cable protector.

In FIG. 5 there is illustrated a cable protector 50 which comprises a flat plate having right-angled edges 501,502 extending longitudinally therealong. The plate has four fixing holes 503–506 and is provided at one short end thereof with two cable-accomodating recesses 507,508.

In FIG. 6 there is illustrated a base plate 60–62 which comprises a horizontal, elongated part 60 and a vertical part 62. Extending from the horizontal part 60 is a center post 600, which extends into the hole 120 in the cabinet 10 and a plurality of bolts 601, 608 which are arranged to enter the previously mentioned holes 301–308 and 402–408 respectively. Two stiffening members 609, 610 connect to the vertical part 62 and are each provided with screw-threaded attachment holes 613–616 which correspond to the holes 503–506 in FIG. 5. The vertical path 62 of the base plate 60–62 is provided with four holes 621–624 which fit four bolts 631–634 extending from a wall attachment 63, said wall attachment in turn, having ten holes 635–644, by which the attachment can be mounted on a wall of the room.

Figure 7:
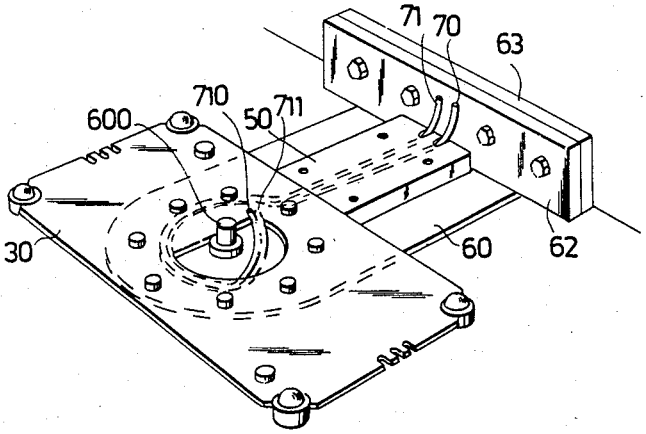
FIG. 7 illustrates the support plate, the spacer arrangement, the cable protector and the base plate assembled together and mounted to a wall, this Figure also illustrating a cable for supplying current to the apparatus.

The support plate 30, the distance member 40 and the base plate 60–62 are assembled together to form a unit by means of the screw-threaded bolts 601–608 and the cabinet, together with its contents, is placed on the plate 30 and firmly secured thereto by means of the center post 600. The cables required for supplying current to the apparatus etc. are passed through the hole 138 in the cabinet and placed in one or more loops in the space formed by the openings 300 and 400, and from therebetween the stiffening members 609,610 whereafter the cable protector 50 is screwed down. As will be understood, if considered practical, the support plate, spacer member and base plate can be assembled in a different order. FIG. 7 illustrates the stage in which the support plate 30 the spacer member 40 and the base plate 60–62 have been assembled together and the cables 70, 71 placed in the manner intended forming coils 710, 711 around the center post 600 and the cable protector 50 has been screwed down, and the whole arrangement securely fixed by means of bolts to the wall attachment 63 and therewith to the adjacent fixed wall of a room in the bank.

Figure 8:
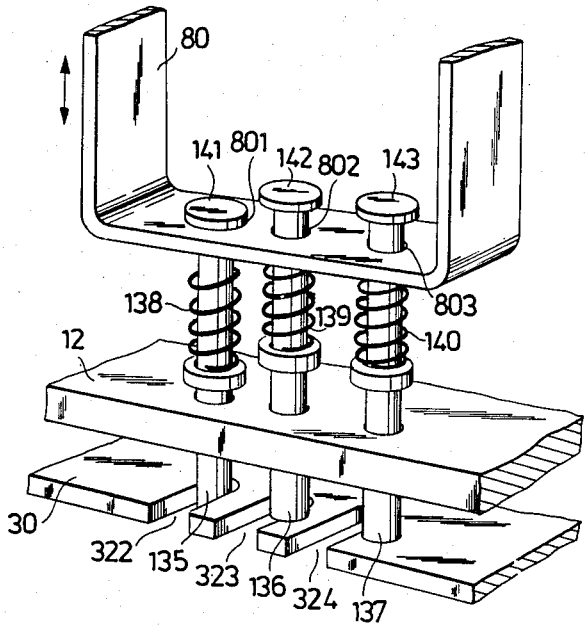
FIG. 8 illustrates a locking arrangement for locking the cabinet in selected positions.

The lock arrangement of the FIG. 8 embodiment comprises three cylindrical lock members 135–137, which are spring-biased by means of pressure or coil springs 138–140 and which are mounted in a stirrup-like member 80 arranged for movement in the cabinet 10, and three locking grooves 322–324 arranged in the support plate 30. This stirrup-like member 80 is arranged to take an upper position during rotating of the cabinet, the lower ends of the lock members being located above the bottom surface 12 of the cabinet 10, and to take a lower position, namely the position illustrated in the figure, when the cabinet 10 is located in its customer serving position or its refilling position, the lower ends of the lock members then extending through the bottom surface 12 of said cabinet for co-action with the locking grooves 322–324. FIG. 8 illustrates a state of the locking arrangement where the lock member 135 has entered its associated groove 322, while the lock members 136 and 137 rest against the upper surface of the plate 30. The distances between the lock members is somewhat greater than the distances between the grooves.

When the cabinet 10 is to be rotated from its customer serving position—i.e. the position in which the apparatus can be used by a customer—to a service or re-filling position, the locking arrangement is first lifted, e.g. by turning a key in a lock, causing the stirrup-like member 80 to be moved upwardly. The cabinet can now be rotated through about 180°, to the re-filling position, whereupon the lock members 135,137 are located immediately above respective locking grooves 319–321, see FIG. 3. When the key is now turned backwards in the lock, the locking arrangement (primarily the member 80) is lowered to a position corresponding to the position illustrated in FIG. 8 whereupon at least one of the lock members 135–137 will be forced into its respective locking groove 319–321 by the force exerted by its spring 138–140.

In the event that none of the lock members enters its locking groove, but that all lock members rest against the plate 30, all that is required is a slight rocking of the cabinet for one of the lock members to enter its associated groove. The cabinet is now locked in position and cannot be moved to another position until the whole of the locking arrangement is lifted with the aid of a key intended herefor. The locking arrangement may comprise a large number of lock members and and locking grooves than that described and illustrated, in which case two lock members may be arranged to simultaneously engage a locking groove.

As clearly shown in FIG. 8 vertical downward movement of the lock members in holes 801–803 arranged in the web of the stirrup-like member 80 is restricted by heads 141–143 provided at the upper ends of respective lock members 135–137. As also shown in FIG. 8, the springs 138–140 are mounted between shoulders on the lock members 135–137 and the underside of member 80.

Figure 9:
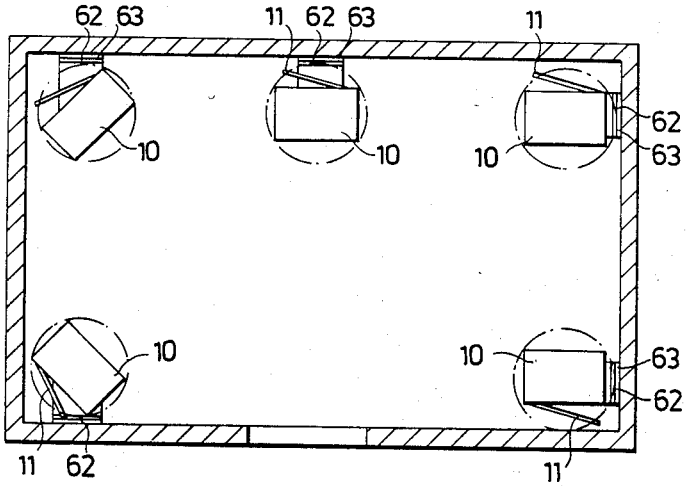
FIG. 9 illustrates an imaginary bank, post office or like establishment as seen from above and containing five apparatus place in positions in which the doors of respective cabinets can only be opened because of the rotatability of the cabinets.

As beforementioned, FIG. 9 illustrates from above a room in a bank in which five apparatus according to the invention are placed in different positions adjacent the walls of the room. The two apparatus shown to the right in the Figure are located in corners with the sides of the cabinet 10 parallel with the walls of the room and the door 11 facing a wall. The two apparatus shown to the left of the Figure are located in corners at an angle of approximately 45°, with the door 11 facing the corner. The fifth apparatus is located centrally of a long wall in the room with the door facing the wall. The paths followed by respective cabinets when rotated for re-filling and servicing purposes are shown by the dotted circles.

In the illustrated exemplary embodiment the base plate 60–62 is designed for attachment to a wall. The base plate can also be designed for attachment to a floor in which case the vertical part 62 is no longer necessary.

What is claimed is:

1. An apparatus in a bank, post office or like establishment for dispensing valuable papers such as banknotes, cheques etc., from a store of such papers to a customer receipt opening, said apparatus comprising a cabinet (10) for housing certain apparatus components, such as said store, means for conveying valuable papers from the store to said receipt opening, at least one keyboard, and said receipt opening, characterized by a base assembly (30-40-60-62) which is connected to the cabinet (10) and which is intended for attachment of the cabinet to a fixed wall or to the floor of a room in said establishment, said base assembly (30-40-60-62) comprising a support plate (30) having an abutment surface for the underside of the cabinet (10), a spacer or distance member (40) and a base plate (60-62) for direct attachment to said fixed wall or said floor, the support plate (30) and the underside of the cabinet (10) being designed to permit limited rotation of the cabinet (10) relative to the base assembly (30-40-60-62), said support plate (30), said distance member (40) and said base plate (60-62) being so constructed that the support plate (30) can be firmly assembled to the distance member (40) and the base plate (60-62) in one of a plurality of distinct positions whereby the cabinet can be placed in a working position in one of a corresponding number of positions relative the base plate (60-62), thereby enabling the position of the cabinet relative to said base assembly to be adjusted in accordance with a selected position of the apparatus in the room in question.

2. An apparatus according to claim 1, characterized in that the support plate (30) and the spacer member (40) have arranged uniformly spaced therein a plurality of holes (301–308 and 402–408, respectively) corresponding to a number of bolts (601–608) which extend from the base plate (60-62) and which are intended for assembling the base plate (60-62) to the spacer member (40) and the support plate (30).

3. An apparatus according to claim 2, characterized in that the support plate (30) and the distance member (40) are each provided with a respective central opening (300 and 400), whereby the support plate (30), the distance member (40) and the base plate (60-62) together form a space for accomodating helical coils (710, 711) of cables (70–71) which are fixedly mounted within the cabinet (10) and which, via the base plate (60-62) extend to a vertical part (62) intended for attachment to said fixed wall of said room; and in that arranged between the distance member (40) and the vertical part (62) of the base plate is a cable protector (50) covering said base plate (60-62) and the cables (70–71) lying thereupon.

4. An apparatus according to claim 1, characterized in that arranged in the corners of the support plate (30) are balls (312–315) on which the cabinet (10) rests when located in the customer serving position; and in that arranged on the underside of the cabinet (10) are balls (121–126) on which the cabinet rolls against the support plate (30) when said cabinet is located in positions between said customer serving position and a service or re-filling position.

5. An apparatus according to claim 4, characterized in that arranged in the corners of the underside of the cabinet (10) are wedge-shaped rest pads (127–130) each of which has a horizontal abutment surface against which the balls (312–315) of the support plate (30) rest when the cabinet is located in said customer serving position or in said service or re-filling position, said rest pads (127–130) being so designed that the cabinet (10), during the first stage of its rotary movement from said customer serving position to said service or re-filling position is lowered until the balls (121–126) arranged on the bottom surface of the cabinet (10) lie against the support plate (30), and during the latter stage of said rotary movement the cabinet is raised until the balls (312–315) arranged on the support plate abut the horizontal abutment surface of the rest pads (127–130).

6. An apparatus according to claim 1, characterizing by a locking arrangement which comprises three or more spring-biassed locking members (135,136,137) mounted in a stirrup-like member (80) arranged for movement in the cabinet, and a corresponding plurality of locking grooves (319, 320, 321 or 322, 323, 324) on two diametrically opposite locations in the support plate (30), said stirrup-like member (80) being arranged to take an upper position when the cabinet is rotated, in which upper position the lower ends of the locking members are located above the bottom surface (12) of the cabinet (10), and to take a lower position when the cabinet (10) is located in its customer serving position or its service or re-filling position, in which lower position the lower ends of the locking members extend through the bottom surface (12) of the cabinet (10) for co-action with the locking groove (319–321 or 322–324), the distances between the locking members, taken two by two, being somewhat greater than the distances between the locking grooves, taken two by two, thereby permitting said co-action between a locking member and a locking groove by means of a rotary movement which in the final stage is smaller than the distance between two lock members.

7. An apparatus according to claim 1, characterized in that arranged on the support plate (30) are two stop shoulders (309,310) intended to co-operate, one at a time with a fixed stop (131) arranged on the underside of the cabinet (10) for restricting the extent to which the cabinet (10) can be rotated.

8. An apparatus according to claim 2 characterized in that arranged in the corners of the support plate (30) are balls (312–315) on which the cabinet (10) rests when located in the customer service position; and in that arranged on the underside of the cabinet (10) are balls (121–126) on which the cabinet rolls against the support plate (30) when said cabinet is located in positions between said customer serving position and a service or re-filling position.

9. An apparatus according to claim 3 characterized in that arranged in the corners of the support plate (30) are balls (312–315) on which the cabinet (10) rests when located in the customer service position; and in that arranged on the underside of the cabinet (10) are balls (121–126) on which the cabinet rolls against the support plate (30) when said cabinet is located in positions between said customer serving position and a service or re-filling position.

10. An apparatus according to claim 2 characterized by a locking arrangement which comprises three or more spring-biased locking members (135, 136, 137) mounted in a stirrup-like member (80) arranged for movement in the cabinet, and a corresponding plurality of locking grooves (319, 320, 321 or 322, 323, 324) on two diametrically opposite locations in the support plate (30), said stirrup-like member (80) being arranged to take an upper position when the cabinet is rotated, in which upper position the lower ends of the locking members are located above the bottom surface (12) of the cabinet (10), and to take a lower position when the cabinet (10) is located in its customer serving position or its service or re-filling position, in which lower position the lower ends of the locking members extend through the bottom surface (12) of the cabinet (10) for co-action with the locking groove (319–321 or 322–324), the distances between the locking members, taken two by two, being somewhat greater than the distances between the locking grooves, taken two by two, thereby permitting said co-action between a locking member and a locking groove by means of a rotary movement which in the final stage is smaller than the distance between two lock members.

11. An apparatus according to claim 3 characterized by a locking arrangement which comprises three or more spring-biased locking members (135, 136, 137) mounted in a stirrup-like member (80) arranged for movement in the cabinet, and a corresponding plurality of locking grooves (319, 320, 321 or 322, 323, 324) on two diametrically opposite locations in the support plate (30), said stirrup-like member (80) being arranged to take an upper position when the cabinet is rotated, in which upper position the lower ends of the locking members are located above the bottom surface (12) of the cabinet (10), and to take a lower position when the cabinet (10) is located in its customer serving position or its service or re-filling position, in which lower position the lower ends of the locking members extend through the bottom surface (12) of the cabinet (10) for co-action with the locking groove (319–321 or 322–324), the distances between the locking members, taken two by two, being somewhat greater than the distances between the locking grooves, taken two by two, thereby permitting said co-action between a locking member and a locking groove by means of a rotary movement which in the final stage is smaller than the distance between two lock members.

12. An apparatus according to claim 4 characterized by a locking arrangement which comprises three or more spring-biased locking members (135, 136, 137) mounted in a stirrup-like member (80) arranged for movement in the cabinet, and a corresponding plurality of locking grooves (319, 320, 321 or 322, 323, 324) on two diametrically opposite locations in the support plate (30), said stirrup-like member (80) being arranged to take an upper position when the cabinet is rotated, in which upper position the lower ends of the locking members are located above the bottom surface (12) of the cabinet (10), and to take a lower position when the cabinet (10) is located in its customer serving position or its service or re-filling position, in which lower position the lower ends of the locking members extend through the bottom surface (12) of the cabinet (10) for co-action with the locking groove (319–321 or 322–324), the distances between the locking members, taken two by two, being somewhat greater than the distances between the locking grooves, taken two by two, thereby permitting said co-action between a locking member and a locking groove by means of a rotary movement which in the final stage is smaller than the distance between two lock members.

13. An apparatus according to claim 5 characterized by a locking arrangement which comprises three or more spring-biased locking members (135, 136, 137) mounted in a stirrup-like member (80) arranged for movement in the cabinet, and a corresponding plurality of locking grooves (319, 320, 321 or 322, 323, 324) on two diametrically opposite locations in the support plate (30), said stirrup-like member (80) being arranged to take an upper position when the cabinet is rotated, in which upper position the lower ends of the locking members are located above the bottom surface (12) of the cabinet (10), and to take a lower position when the cabinet (10) is located in its customer serving position or its service or re-filling position, in which lower position the lower ends of the locking members extend through the bottom surface (12) of the cabinet (10) for co-action with the locking groove (319–321 or 322–324), the distances between the locking members, taken two by two, being somewhat greater than the distances between the locking grooves, taken two by two, thereby permitting said co-action between a locking member and a locking groove by means of a rotary movement in the final stage is smaller than the distance between two lock members.

14. An apparatus according to claim 2, characterized in that arranged on the support plate (30) are two stop shoulders (309, 310) intended to co-operate, one at a time with a fixed stop (131) arranged on the underside of the cabinet (10) for restricting the extent to which the cabinet (10) can be rotated.

15. An apparatus according to claim 3, characterized in that arranged on the support plate (30) are two stop shoulders (309, 310) intended to co-operate, one at a time with a fixed stop (131) arranged on the underside of the cabinet (10) for restricting the extent to which the cabinet (10) can be rotated.

16. An apparatus according to claim 4, characterized in that arranged on the support plate (30) are two stop shoulders (309, 310) intended to co-operate, one at a time with a fixed stop (131) arranged on the underside of the cabinet (10) for restricting the extent to which the cabinet (10) can be rotated.

17. An apparatus according to claim 5, characterized in that arranged on the support plate (30) are two stop shoulders (309, 310) intended to co-operate, one at a time with a fixed stop (131) arranged on the underside of the cabinet (10) for restricting the extent to which the cabinet (10) can be rotated.

18. An apparatus according to claim 6, characterized in that arranged on the support plate (30) are two stop shoulders (309, 310) intended to co-operate, one at a time with a fixed stop (131) arranged on the underside of the cabinet (10) for restricting the extent to which the cabinet (10) can be rotated.

* * * * *